US007578130B1

(12) United States Patent
Kraemer et al.

(10) Patent No.: US 7,578,130 B1
(45) Date of Patent: Aug. 25, 2009

(54) METHODS AND SYSTEMS FOR COMBUSTION DYNAMICS REDUCTION

(75) Inventors: Gilbert Otto Kraemer, Greer, SC (US); Balachandar Varatharajan, Cincinnati, OH (US); Shiva Srinivasan, Greer, SC (US); John Joseph Lynch, Wilmington, NC (US); Ertan Yilmaz, Albany, NY (US); Kwanwoo Kim, Greer, SC (US); Benjamin Lacy, Greer, SC (US); Sarah Crothers, Greenville, SC (US); Kapil Kumar Singh, Rexford, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/123,876

(22) Filed: May 20, 2008

(51) Int. Cl.
*F02C 1/00* (2006.01)

(52) U.S. Cl. ..... 60/737

(58) Field of Classification Search ..... 60/737, 60/738, 748, 725, 747, 776
See application file for complete search history.

(56) References Cited

U.S. PATENT DOCUMENTS

| | | | | |
|---|---|---|---|---|
| 5,193,346 | A * | 3/1993 | Kuwata et al. | 60/737 |
| 5,435,126 | A * | 7/1995 | Beaudoin | 60/39.463 |
| 5,660,044 | A * | 8/1997 | Bonciani et al. | 60/737 |
| 5,676,538 | A * | 10/1997 | Lovett | 431/182 |
| 5,943,866 | A | 8/1999 | Lovett et al. | |
| 6,164,055 | A | 12/2000 | Lovett et al. | |
| 6,438,961 | B2 | 8/2002 | Tuthill et al. | |
| 6,786,046 | B2 * | 9/2004 | Wiebe et al. | 60/737 |
| 6,931,854 | B2 * | 8/2005 | Saitoh et al. | 60/737 |
| 7,340,900 | B2 | 3/2008 | Xu et al. | |
| 2003/0110774 | A1 * | 6/2003 | Saitoh | 60/737 |
| 2004/0103663 | A1 * | 6/2004 | Haynes et al. | 60/737 |
| 2004/0148936 | A1 * | 8/2004 | Moriya et al. | 60/737 |
| 2005/0268616 | A1 | 12/2005 | Widener | |
| 2006/0236700 | A1 * | 10/2006 | Saitoh et al. | 60/737 |
| 2007/0089426 | A1 | 4/2007 | Vandale et al. | |
| 2007/0130954 | A1 | 6/2007 | Lynch et al. | |
| 2007/0151255 | A1 * | 7/2007 | Johnson et al. | 60/776 |
| 2008/0053097 | A1 * | 3/2008 | Han et al. | 60/737 |

FOREIGN PATENT DOCUMENTS

| | | |
|---|---|---|
| EP | 1806534 | 12/2006 |

* cited by examiner

*Primary Examiner*—Michael Cuff
*Assistant Examiner*—Phutthiwat Wongwian
(74) *Attorney, Agent, or Firm*—Sutherland Asbill and Brennan LLP

(57) ABSTRACT

Methods and systems for combustion dynamics reduction are provided. A combustion chamber may include a first premixer and a second premixer. Each premixer may include at least one fuel injector, at least one air inlet duct, and at least one vane pack for at least partially mixing the air from the air inlet duct or ducts and fuel from the fuel injector or injectors. Each vane pack may include a plurality of fuel orifices through which at least a portion of the fuel and at least a portion of the air may pass. The vane pack or packs of the first premixer may be positioned at a first axial position and the vane pack or packs of the second premixer may be positioned at a second axial position axially staggered with respect to the first axial position.

20 Claims, 4 Drawing Sheets

METHODS AND SYSTEMS FOR COMBUSTION DYNAMICS REDUCTION

STATEMENT REGARDING FEDERALLY SPONSORED RESEARCH OR DEVELOPMENT

This invention was made with the U.S. Government support under contract number DE-FC26-05NT42643 awarded by the U.S. Department of Energy. The U.S. Government has certain rights in this invention.

TECHNICAL FIELD

The subject matter disclosed herein relates to gas turbine engines and more specifically relates to methods and systems for combustion dynamics reduction.

BACKGROUND OF THE INVENTION

Gas turbines have traditionally used diffusion flame combustion chambers because of their reliable performance and reasonable stability characteristics. However, as a result of the high temperatures involved during combustion, this type of combustion chamber may produce unacceptably high levels of nitrogen oxide pollutants called $NO_X$. Due to increasingly strict regulation on pollutant emissions, industrial power generation manufacturers have turned to low emission technology, and many new power plants now employ low emission gas turbine engines. These gas turbines achieve low $NO_X$ emission by using Lean Pre-Mixed (LPM) combustion. In these systems, the fuel (typically natural gas) is mixed with a relatively high proportion of air before burning. The thermal mass of the excess air present in the combustion chamber absorbs the heat generated during combustion, thus limiting the temperature rise to a level where thermal $NO_X$ is not formed.

While lean premixed combustion has demonstrated significant reduction in $NO_x$ emissions, LPM combustion may suffer from combustion instabilities due to the lean nature of the fuel flow in that operating range. This phenomenon is also known as combustion dynamics.

With lean premixed fuel, the combustion flame burns on the border of not having enough fuel to keep burning, and a phenomenon analogous to a flickering flame takes place, giving rise to pressure fluctuations. These pressure fluctuations excite the acoustic modes of the combustion chamber resulting in large amplitude pressure oscillations. The oscillations produced travel upstream into the fuel nozzle and create an oscillating pressure drop across the fuel injectors. This may result in an oscillatory delivery of fuel to the combustion chamber. When the oscillating fuel-air mixture burns in the combustion chamber, the flame area fluctuates giving rise to heat release oscillations. Depending upon the relative phasing of these heat release oscillations and the acoustic waves, a potentially self-exciting feedback loop may be created giving rise to oscillations whose amplitude grows with time. These oscillations typically occur at discrete frequencies that are associated with natural acoustic modes of the combustion chamber and its higher order harmonics thereof.

Such combustion driven instabilities have adverse effect on the system performance and operating life of the combustion chamber. The oscillations and their resultant structural vibrations can cause fretting and wearing at the walls of the combustion chamber, reducing high cycle fatigue life and affecting the overall performance.

Accordingly, there exists a need for methods and systems providing combustion dynamics reduction. There exists a further need to simultaneously reduce the sensitivity to fuel composition.

BRIEF DESCRIPTION OF THE INVENTION

Embodiments of the invention can address some or all of the needs described above. Embodiments of the invention are directed generally to methods and systems for combustion dynamics reduction.

According to one example embodiment of the invention, a combustion chamber for a gas turbine engine is provided. The combustion chamber includes at least a first premixer and a second premixer. Each premixer may include at least one fuel injector, at least one air inlet duct, and at least one vane pack for at least partially mixing the air from the air inlet duct or ducts and fuel from the fuel injector or injectors. According to this example embodiment, each vane pack may include a plurality of fuel orifices through which at least a portion of the fuel and at least a portion of the air may pass. Also according to this example embodiment, the vane pack or packs of the first premixer may be positioned at a first axial position and the vane pack or packs of the second premixer may be positioned at a second axial position axially staggered with respect to the first axial position.

According to another example embodiment of the invention, a method for combusting fuel in a combustion chamber is provided. This example method includes mixing fuel and air in a first premixer that includes at least one fuel injector, at least one air inlet duct, and at least one vane pack at a first axial position, and mixing fuel and air in a second premixer that includes at least one fuel injector, at least one air inlet duct, and at least one vane pack at a second axial position axially staggered with respect to the first axial position. The example method further includes discharging the mixed fuel and air from the first premixer and the second premixer to a combustion chamber, and combusting at least a portion of the mixed fuel and air from the first premixer and the second premixer in the combustion chamber.

According to yet another example embodiment a gas turbine engine is provided. The gas turbine engine includes a compressor, a combustion chamber, and at least a first premixer and a second premixer associated with the combustion chamber. According to this example system, each premixer may include at least one fuel injector, at least one air inlet duct, and at least one vane pack for at least partially mixing air from the air inlet duct or ducts and fuel from the fuel injector or injectors. Also according to this example system, each of the vanes includes multiple fuel orifices through which at least a portion of the fuel and at least a portion of the air may pass. In this example system, the vane pack or packs of the first premixer may be positioned within the first premixer at a first axial position and the vane pack or packs of the second premixer may be positioned within the second premixer at a second axial position axially staggered with respect to the first axial position.

Other embodiments and aspects of the invention will become apparent from the following description taken in conjunction with the following drawings.

BRIEF DESCRIPTION OF THE DRAWINGS

Figure 1:
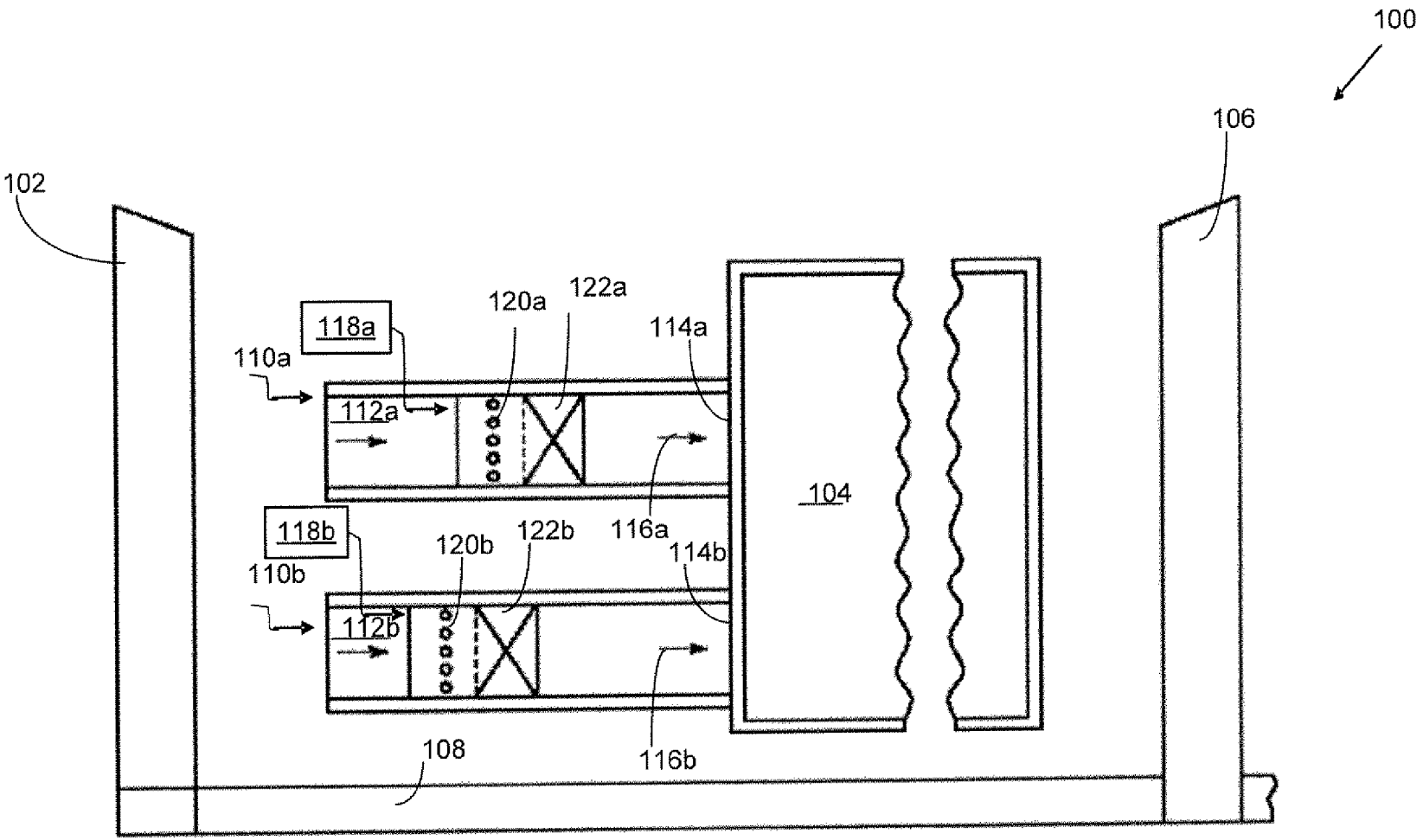
Figure 2:
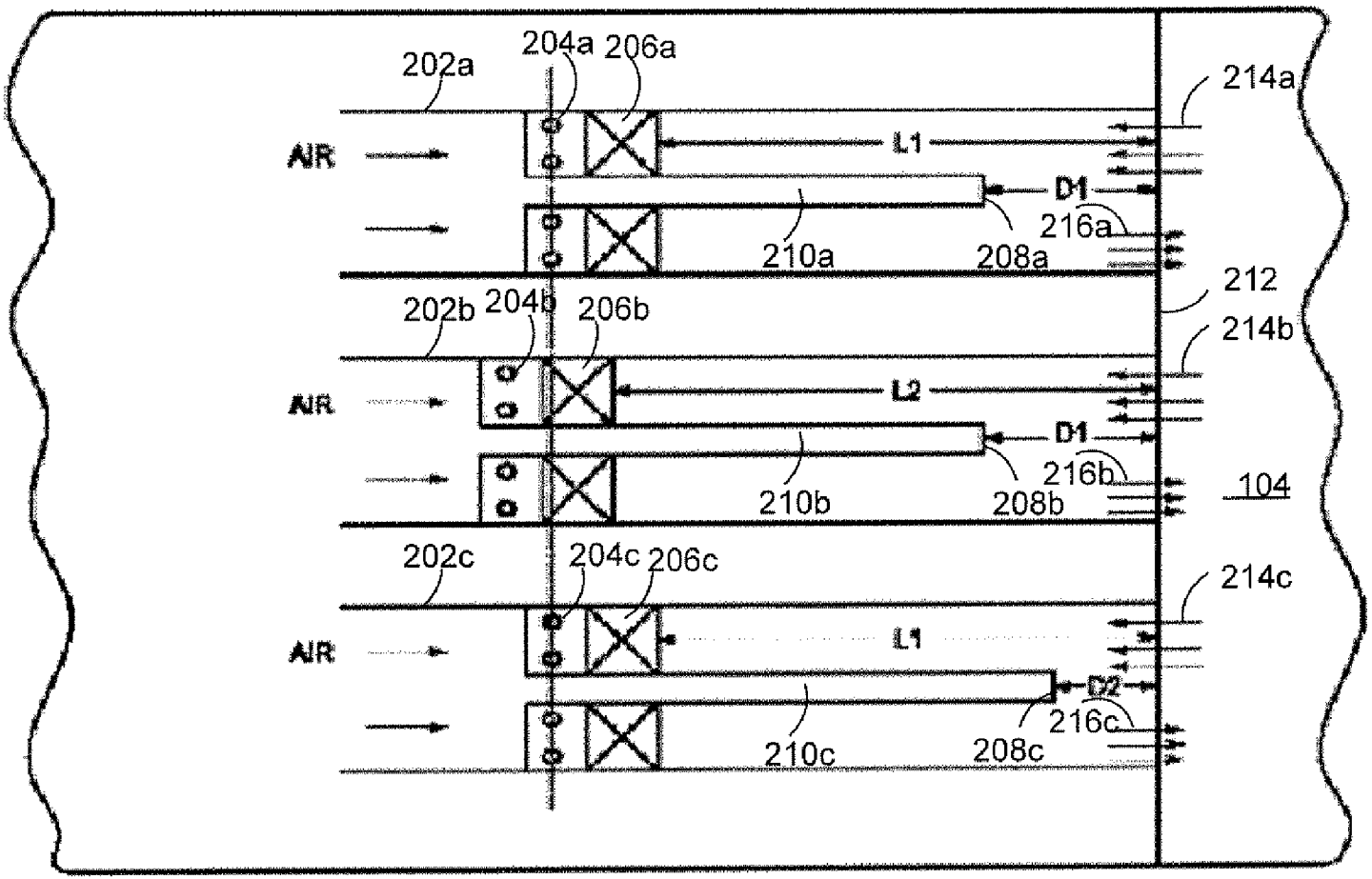
Figure 3:
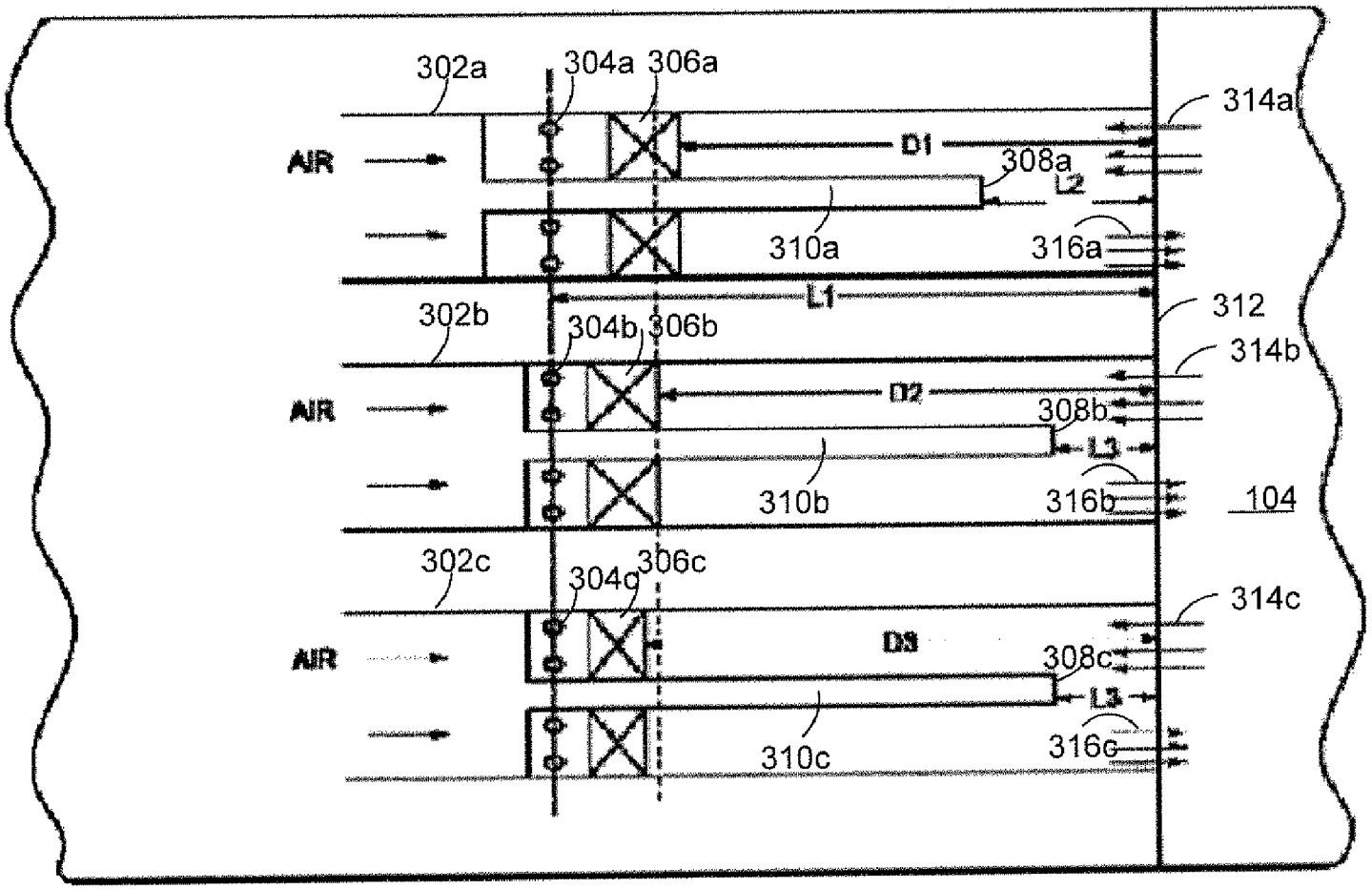
Figure 4:
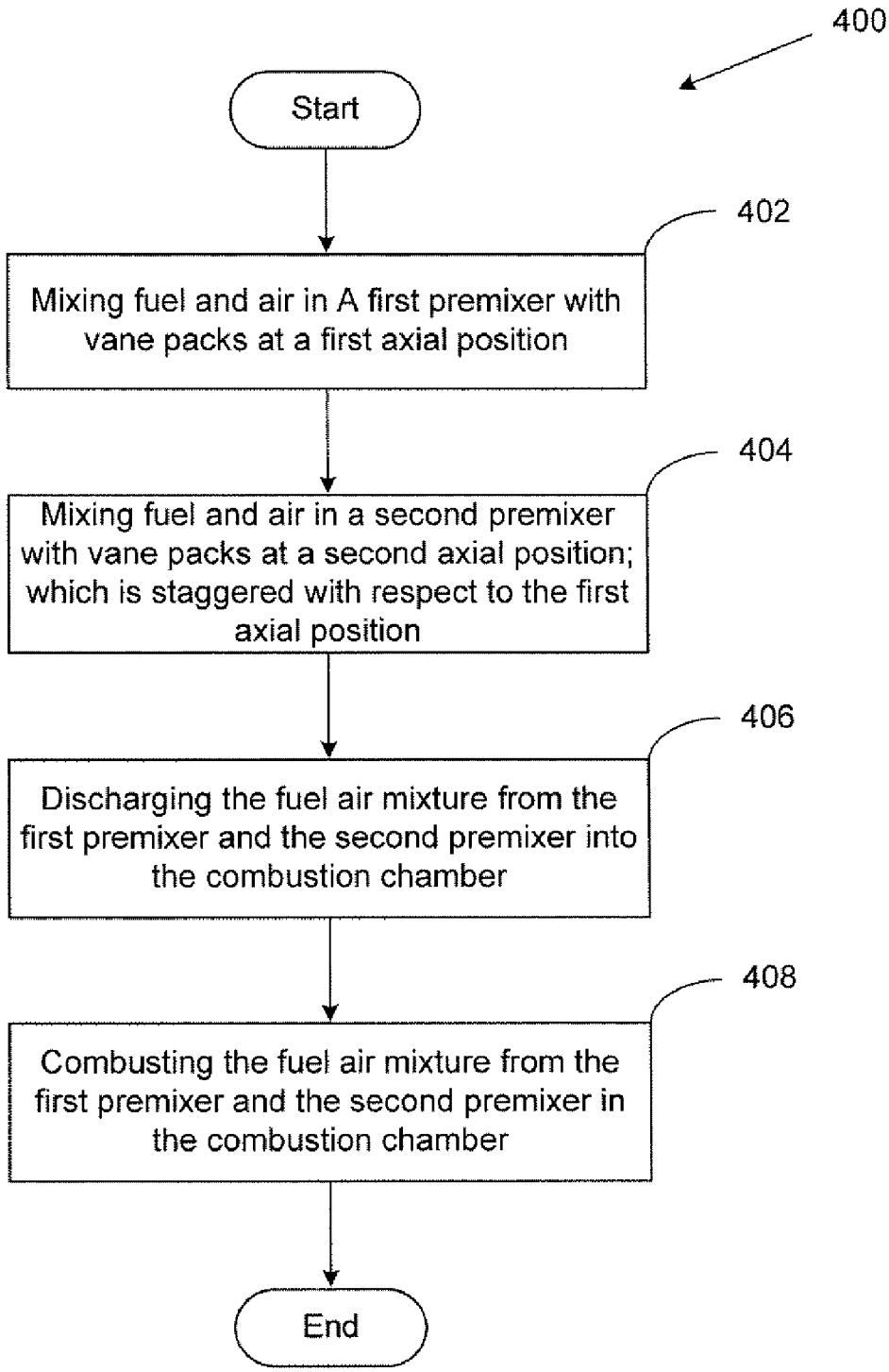

Having thus described embodiments of the invention in general terms, reference will now be made to the accompanying drawings, which are not necessarily drawn to scale, and wherein:

FIG. 1 is an schematic representation of a portion of an example gas turbine engine, in accordance with one embodiment of the invention;

FIG. 2 is a sectional view of a portion of an example gas turbine engine, in accordance with one embodiment of the invention;

FIG. 3 is a sectional view of a portion of an example gas turbine engine, in accordance with one embodiment of the invention;

FIG. 4 is a flow chart illustrating an example process for combusting fuel, in accordance with one embodiment of the invention.

DETAILED DESCRIPTION OF THE INVENTION

Example embodiments of the invention now will be described more fully hereinafter with reference to the accompanying drawings, in which some, but not all embodiments are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 is a schematic representation of a portion of an example gas turbine engine 100 according to one embodiment of the invention. The gas turbine engine 100 may include a low $NO_X$ combustion chamber 104. The engine 100 may also include a compressor 102, which is in a serial flow communication with the low $NO_X$ combustion chamber 104 and a turbine 106. The turbine 106 may be coupled to the compressor 102 through a shaft 108. The shaft 108 may be extended to power an external load (not shown in figure) by the turbine 106. In one embodiment, during typical operation of the gas turbine engine 100, the compressor 102 may compress an incoming airflow and guide the airflow into the low $NO_X$ combustion chamber 104 through at least one of multiple premixers 110*a* and 110*b*.

In one embodiment of the invention, the engine 100 includes a first premixer 110*a* and a second premixer 110*b*; though, in other embodiments any number of premixers may be included. Each of the premixers 110*a* and 110*b* may be tubular in shape, and include air inlet ducts 112*a* and 112*b* respectively, at an upstream end for receiving compressed air from the compressor 102; and outlet ducts 114*a* and 114*b* respectively, at the opposite downstream end, which discharge a swirled fuel-air mixture 116*a* and 116*b* into the combustion chamber 104. Each premixer 110*a* and 110*b* may include at least one fuel injector 118*a* and 118*b* respectively, for injecting fuel such as syn-gas or natural gas into the premixers. Each of the premixers 110*a* and 110*b* may also include at least one vane pack, for example, a first vane pack 122*a* and a second vane pack 122*b*, which include multiple spaced apart vanes (not shown in figure) arranged circumferentially about the axis of the premixers 110*a* and 110*b*. As shown in FIG. 1, the vane pack or packs of the first premixer 110*a* may be positioned at a first axial position and the vane pack or packs of the second premixer 110*b* may be positioned at a second axial position axially staggered with respect to the first axial position (described in more detail with reference to FIGS. 2 and 3). Each of the vanes may have multiple fuel orifices 120*a* and 120*b* formed therein. The first vane pack 122*a* and the second vane pack 122*b* provide swirl to the fuel-air mixture to produce a swirled flow 116*a* and 116*b*, which is then fed into the combustion chamber 104 to generate a combustion flame. The fuel orifices 120*a* and 120*b* improve the circumferential distribution of fuel from the fuel injectors 118*a* and 118*b* within the premixers 110*a* and 110*b*, and promote uniform mixing of fuel and air. It is appreciated that although only two premixers are illustrated in FIG. 1 and described herein, other example embodiments may include any number of premixers.

Generally, the fuel injectors 118*a* and 118*b* may use fuel reservoirs, conduits, valves and pumps for channeling the fuel into the premixers 110*a* and 110*b* through the fuel orifices 120*a* and 120*b* respectively. In an embodiment of the invention, the fuel used may be a gaseous fuel, which is being channeled into the premixers 110*a* and 110*b*.

In various gas turbine engines 100, such as a low $NO_X$ engine, combustion flames in the combustion chamber 104 may burn with various oscillating frequencies depending on the dynamics of the flame. If any of these frequencies of heat release oscillation match the fundamental frequency of the combustion chamber 104 or any of its higher harmonics thereof, high amplitude pressure oscillations may occur in the combustion chamber 104. These pressure oscillations may propagate upstream from the combustion chamber 104 into each of the premixers 110*a* and 110*b*. In turn, such a propagation of pressure oscillations may cause an oscillation near the fuel orifices. Oscillations may result in a fluctuation in the mass flow rate of fuel discharge from the fuel orifices 120*a* and 120*b*, giving rise to a fluctuating disturbance in the fuel-air mixture. This disturbance may then travel downstream as a fuel concentration wave and into a flame burning region. If the heat release oscillations resulting from these fuel concentration waves are in phase with the high amplitude pressure oscillations present in the combustion chamber 104, a self exciting feedback loop may be created, resulting in combustion dynamics. When combustion dynamics occur, the system obeys Rayleigh's criterion wherein net energy is added to the acoustic field in a point in space when heat additions and pressure oscillations are positively related in time. Accordingly, the amplitude of the pressure oscillations grow with time and the system may become unstable. If however, the pressure oscillations differ from the heat oscillations by a phase of 180° ($\pi$ radians) and destructive interference takes place, Rayleigh's criterion is violated, dampening the pressure oscillations and thereby suppressing the combustion dynamics.

In one embodiment of the invention, Rayleigh's criterion may be applied to dampen the acoustic field by causing destructive interference between the heat release oscillations and the pressure oscillations in the combustion chamber 104.

FIG. 2 is a sectional view of a portion of an example gas turbine engine 100 including three premixers, in accordance with one embodiment of the invention; though, in other embodiments any number of premixers may be included. A first premixer, a second premixer and a third premixer are hereinafter referred to as premixer A 202*a*, premixer B 202*b*, and premixer C 202*c*, respectively. Each of the premixers 202*a*, 202*b*, and 202*c* may include at least one vane pack. In an exemplary embodiment, a first vane pack, a second vane pack and a third vane pack are included in premixers 202*a*, 202*b*, and 202*c*, respectively. The first vane pack, the second vane pack and the third vane pack may be referred to as vane pack A 206*a*, vane pack B 206*b* and vane pack C 206*c*, respectively. Each of the vane packs 206*a*, 206*b*, and 206*c* may contain one or more vanes, wherein each vane may contain one or more fuel orifices 204*a*, 204*b*, and 204*c*, respectively, for introducing fuel into the air stream. In one embodiment of the invention, the premixers 202*a*, 202*b*, and 202*c* may also include diffusion tips 20*a*, 208*b*, and 208*c* located at or near the distal portion of the center body 210*a*, 210*b* and 210*c* of each premixer 202*a*, 202*b*, and 202*c*, respectively.

In one exemplary embodiment of the invention, with reference to premixer A 202*a* and premixer B 202*b* of FIG. 2, the gas turbine engine 100 may include at least two premixers with staggered vane pack locations. Vane pack A 206*a* of premixer A 202*a* may be placed at a first axial position which is at a distance $L_1$ upstream from a flame front 212. Similarly, vane pack B 206*b* of premixer B 202*b* may be placed at a second axial distance $L_2$ from the flame front 212. $L_1$ may or may not be equal to $L_2$. In the exemplary embodiment illustrated in FIG. 2, however, $L_1$ is not equal to $L_2$, resulting in the first axial position of vane pack A 206*a* being axially staggered with respect to the second axial position of vane pack B 206 *b*. This staggered arrangement of the vane packs 206*a* and 206*b* may at least partially serve to attenuate combustion dynamics in the combustion chamber 104. It is appreciated that in other embodiments of the invention, other vane packs may similarly be axially staggered at one or more relative distances from each other.

The high amplitude pressure oscillations 214*a* that may occur in the combustion chamber 104 as a result of the coupling between heat release oscillations and acoustic frequencies of the combustion chamber 104, travel upstream from a flame front 212 and reach the fuel orifices 204*a* of premixer A 202*a* after a time delay. This first time delay may be represented as:

$$\frac{L_1}{c-v}$$

where c is the speed of sound and v is the average velocity of the airflow in each of the premixers 202*a* and 202*b*. The first fuel concentration wave (hereinafter referred to as fuel concentration wave 216*a*) then generated at the fuel orifices 204*a* of premixer A 202*a* travels downstream and reaches the flame front 212 after a further time delay. This other time delay may be represented as:

$$\frac{L_1}{v}.$$

Accordingly, the total time delay may be represented as:

$$L_1\left(\frac{1}{c-v}+\frac{1}{v}\right).$$

Similarly, the pressure oscillations 214*b* traveling upstream into the premixer B 202*b* produces a second fuel concentration wave (hereinafter referred to as fuel concentration wave 216*b*) which arrives at the flame front 212 after a total time delay represented as:

$$L_2\left(\frac{1}{c-v}+\frac{1}{v}\right).$$

This time delay reflects as a change in phase of the heat release oscillations resulting from the fuel concentration waves 216*a* and 216*b*. The change in phase is at least partly governed by the parameters $L_1$ and $L_2$, respectively, which results from the axial staggering of the vane packs 206*a* and 206*b*. Thus, the axial spacing between $L_1$ and $L_2$ may be selected such that the fuel concentration wave 216*a* generated in premixer A 202*a* and the fuel concentration wave 216*b* generated in premixer B 202*b* may have a phase difference of approximately 180° (π radians) between them. This may conceivably result in the various fuel sources canceling out each other such that constant fuel concentration is maintained from the premixers 202*a* and 202*b*.

However, experimentally it has been found that, in some embodiments, the axial spacing between the vane packs 206*a* and 206*b* may not be set arbitrarily. The choice may be limited to within an acceptable range of values depending on two considerations: flashback and emission performance in the premixers 202*a* and 202*b*. The axial spacing between L1 and L2 may be so selected that residence time of the fuel concentration wave 216*a* and 216*b* in the premixers 202*a* and 202*b*, respectively, may not be long enough to give rise to an auto ignition temperature and hence lead to flashback. Further, the proper mixing of the fuel-air mixture is governed by the swirl dynamics, which in turn depend on the distance between the vane packs 206*a* and 206*b* and the flame front 212. Inadequate mixing between the fuel and the air may result in an undesirable emission performance in the combustion chamber 104. Accordingly, the illustrated embodiment may at least partially attenuate the fuel concentration waves 216*a* and 216*b* by means of destructive interference depending on the operating conditions and the nature of the fuel used.

In another example embodiment of the invention, with reference to premixer A 202*a* and premixer C 202*c* of FIG. 2, an example gas turbine engine 100 may include at least two premixers that attenuate combustion dynamics, while additionally improving fuel flexibility, by staggering the diffusion tip locations. In this example embodiment, the diffusion tip 208*a* of premixer A 202*a* may be placed at an axial distance $D_1$ from the flame front 212 while the diffusion tip 208*c* of premixer C 202*c* may be placed at an axial distance $D_2$ from the flame front 212, such that $D_1$ is not equal to $D_2$. Accordingly, the diffusion tip 208*a* and 208*c* locations are axially staggered with respect to each other. A diffusion tip may be formed as a flat disk, or other surface, for providing acoustic reflection. In example embodiments, the diffusion tips may also have fuel orifices (not shown in figure) for maintaining the flame during low operating load conditions. Additionally, as is illustrated by FIG. 2, in one example embodiment, vane pack A 206*a* of premixer A 202*a* and vane pack C 206*c* of premixer C 202*c* may be axially aligned in the same plane—positioned at an axial distance $L_1$ from the flame front 212. However, as described above, in other example embodiments, the vane pack locations may also be axially staggered relative to each other, such as is shown by the relative axial positions of vane pack A 206*a* and vane pack B 206*b*.

Axially staggering the diffusion tips causes the time delay associated with the reflection of the pressure oscillations 214*a* and 214*c* from the diffusion tips 208*a* and 208*c*, respectively, to generate a phase difference in the reflected pressure oscillations, which then are subject to interference with the pressure oscillations 214*a* and 214*c* in the combustion chamber 104. Furthermore, according to this example embodiment, the fuel concentration waves 216*a* and 216*c* generated in the premixers 202*a* and 202*c*, respectively, may partially attenuate each other while simultaneously producing heat release oscillations with phase difference, which are subject to interference with the pressure oscillations 214*a* and 214*b* in the combustion chamber 104. However, staggering the diffusion tips 208*a* and 208*c* may affect the swirl dynamics of the flow, in some embodiments, such that the relative spacing between the diffusion tips is to be selected to provide acceptable mixing of the fuel-air mixture.

In yet another embodiment of the invention, with reference to premixer B 202*b* and premixer C 202*c* of FIG. 2, the gas turbine engine 100 may include at least two premixers to attenuate combustion dynamics in the combustion chamber 104 by staggering both the vane pack locations and the diffusion tip locations. Vane pack B 206*b* of premixer B 202*b* may be placed at a first axial position at a distance $L_2$ from the flame front 212 while vane pack C 206*c* of premixer C 202*c* may be placed at a second axial position at a distance $L_1$ from the flame front 212, such that $L_1$ is not equal to $L_2$. The vane packs 204*b* and 204*c* in this example embodiment are axially staggered with respect to each other. Similar to the previously described embodiment, the diffusion tip 208*b* of premixer B 202*b* may be placed at an axial distance $D_1$ from the flame front 212, while the diffusion tip 208*c* of premixer C 202*c* may be placed at an axial distance $D_2$ from the flame front 212, such that $D_1$ is not equal to $D_2$. Accordingly, the diffusion tips 208*b* and 208*c* are also axially staggered with respect to each other. In this embodiment having staggered vane packs and diffusion tips, the parameters controlling the relative phasing between the pressure oscillations 214*b* and 214*c* in the combustion chamber 104 and the fuel concentration waves 216*b* and 216*c* are the relative staggered distances between the vane packs and the diffusion tips.

In another example embodiment of the invention, with reference to the premixer A 202*a* and the premixer B 202*b* of FIG. 2, the gas turbine engine 100 may include at least two premixers having both staggered vane pack locations and staggered fuel orifice locations. In this example embodiment, the vane pack 206*a* of premixer A 202*a* may be positioned at an axial distance $L_1$ from the flame front 212 while the vane pack 206*b* of premixer B 202*b* may be positioned at an axial distance $L_2$ from the flame front 212, such that $L_1$ is not equal to $L_2$, as previously described. Accordingly, the vane pack 206*a* and 206*b* locations are axially staggered with respect to each other. Additionally, in this example embodiment, the fuel orifice 204*a* of premixer A 202*a* and the fuel orifice 204*b* of premixer B 202*b* may be axially staggered relative to each other. The axial staggering of the fuel orifices 204*a* and 204*b* may result at least in part from the axial staggering of the vane packs 206*a* and 206*b*, in which the fuel orifices are formed. However, in other embodiments, the fuel orifices may be staggered as a result of staggering the relative fuel orifice locations in one vane pack as compared to the relative fuel orifice locations in another vane pack.

Accordingly, the parameters $L_1$, $L_2$, $D_1$, and $D_2$, which may represent relative locations of the vane packs, the diffusion tips, and/or the fuel orifices, can be accordingly selected to attenuate combustion dynamics in the combustion chamber 104. The increase in the number of parameters provides flexibility of operation, allows for controlling the occurrence of combustion dynamics, increases flexibility of use with a wider variety of fuel types, and improves engine emission performance.

FIG. 3 is a sectional view of a portion of an example gas turbine engine 100 including three premixers with axially staggered vane packs and/or diffusion tips and axially aligned fuel orifices, in accordance with one embodiment of the invention. In this example embodiment, the engine 100 includes a first premixer, a second premixer and a third premixer, which are hereinafter referred to as premixer D 302*a*, premixer E 302*b*, and premixer F 302*c*; though, in other embodiments any number of premixers may be included. Premixers 302*a*, 302*b*, and 302*c* may include fuel orifices 304*a*, 304*b*, and 304*c*, a first vane pack 306*a*, a second vane pack 306*b*, and a third vane pack 304*c*, which are hereinafter referred to as vane pack D 306*a*, vane pack E 306*b*, and vane pack F 306, and diffusion tips 308*a*, 308*b*, and 308*c* in the center body 310*a*, 310*b*, and 310*c*, respectively. The fuel injectors (not shown in figure) communicate with the fuel orifices 304*a*, 304*b*, and 304*c* and are placed such that the fuel is first introduced into the airflow and thereafter swirl is imparted by the vane packs 306*a*, 306*b*, and 306*c* downstream from the fuel injectors. This positioning of the fuel injectors and the vane packs 306*a*, 306*b*, and 306*c* provides improved mixing between fuel and air due to the shearing effect provided by the vane packs 306*a*, 306*b*, and 306*c* atomizing and swirling the flow.

In the example embodiment illustrated in FIG. 3, with reference to premixer E 302*b* and premixer F 302*c*, the fuel orifices 304*b* and 304*c* of the premixers 302*b* and 302*c* are axially aligned, being located at substantially the same distance from the flame front 312, whereas exit locations or trailing edges of the vane packs 306*b* and 306*c* are axially staggered with respect to each other. As illustrated by this example embodiment, the fuel orifices 304*b* may be placed at an axial distance $L_1$ from the flame front 312 while the exit location of vane pack E 306*b* may be placed at a first axial position at a distance $D_2$ from the flame front 312. In this example, the fuel orifices 304*c* of premixer F 302*c* may also be placed at an axial distance $L_1$ from the flame front 312 while the exit location of vane pack F 306*c* may be placed at a second axial position at a distance $D_3$ from the flame front 312, such that $D_2$ is not equal to $D_3$. As used herein, the term "exit location" may refer to the trailing edge of the vane pack blades or the most downstream located portion of the vane pack. Accordingly, in this example embodiment, the axial position of the exit location of vane pack E 306*b* is axially staggered with respect to the axial position of the exit location of vane pack F 306*c*, while the fuel orifices 304*b* and 304*c* are axially aligned. This may be accomplished in one embodiment with vane packs that are proportioned differently, such that the respective fuel orifices may align at the same axial position, but the exit locations of the vane packs may be located at different axial positions. For example, as illustrated in FIG. 3, the vane packs 306*a*, 306*b*, and 306*c* are each proportioned differently, allowing for the fuel orifices to align, but the exit locations of the vane packs to be located at staggered positions.

Also with reference to premixer E 302*b* and premixer F 302*c*, the high amplitude pressure oscillations 314*b* formed in the combustion chamber 104 travel upstream from the flame front 312 and reach the fuel orifices 304*b* of premixer E 302*b* after a time lag. The time lag may be represented as:

$$\frac{L_1}{c-v}.$$

The pressure oscillations 314*b* also reach the vane pack E 306*b* after a time lag. The time lag in this case may be represented as:

$$\frac{D_2}{c-v}$$

where c is the speed of sound and v is the average flow velocity in each of the premixers 302*b* and 302*c*. The pressure oscillations 314*b* and 314*c* interact with the fuel orifices 304*b* and 304*c* and vane packs 306*b* and 306*c* of each of the premixers 302*b* and 302*c* giving rise to a first fuel concentration wave and a second fuel concentration wave (hereinafter referred to as fuel concentration waves 316*b* and 316*c* respectively) which then travel downstream and reach the flame front 312 after a further time lag. The time lag associated with reaching the flame front 312 from the fuel orifices 304*b* may be represented as:

$$\frac{L_1}{v},$$

and the time lag associated with reaching the flame front 312 from vane pack E 304*b* may be represented as:

$$\frac{D_2}{v}.$$

Accordingly, the total time delay associated with the fuel concentration wave 316*b* in premixer E 302*b* in this example embodiment may be represented as:

$$L_1\left(\frac{1}{c-v}+\frac{1}{v}\right)+D_2\left(\frac{1}{c-v}+\frac{1}{v}\right).$$

Similarly, the time lag associated with the fuel concentration wave 316*c* in premixer F 302*c* in this embodiment may be represented as:

$$L_1\left(\frac{1}{c-v}+\frac{1}{v}\right)+D_3\left(\frac{1}{c-v}+\frac{1}{v}\right).$$

This time delay reflects a change in phase of the heat release oscillations resulting from the fuel concentration waves 316*b* and 316*c*, which may be at least partly affected by the parameters $L_1$, $D_2$, and $D_3$, respectively. Thus, by suitably selecting the distances $L_1$, $D_2$, and $D_3$, the fuel concentration waves 316*b* and 316*c* formed in the premixers 302*b* and 302*c* may have a phase difference of approximately 180° (π radians) between them, in one example. A phase difference allows the fuel concentration waves 316*b* and 316*c* generated in the fuel orifices 304*b* and 304*c* and the vane packs 306*b* and 306*c* to at least partially cancel out each other to suppress combustion dynamics.

In another example embodiment, also illustrated by FIG. 3, with reference to premixer D 302*a* and premixer E 302*b*, an example engine may include premixers with axially staggered diffusion tips in accordance with an embodiment of the invention. In this example, the diffusion tip 308*a* of premixer D 302*a* may be axially staggered with respect to the diffusion tip 308*b* of premixer E 302*b*. The diffusion tip 308*a* may be positioned at an axial distance $L_2$ from the flame front 312 while the diffusion tip 308*b* may be positioned at an axial distance $L_3$ from the flame front 312, such that $L_2$ is not equal to $L_3$. As described above, the fuel orifices 304*a* and 304*b* may be axially aligned, positioned at an axial distance $L_1$ from the flame front 312. In this example, the vane packs 306*a* and 306*b* are axially staggered with respect to each other, vane pack D 306*a* being positioned at a first axial position at a distance $D_1$ from the flame front 312 and vane pack E 306*b* being positioned at a second axial position at a distance $D_2$ from the flame front 312. It is appreciated, however, that in other example embodiments, one or more of the fuel orifices may be staggered, such as is described with reference to FIG. 2, one or more of the vane packs may be aligned, or one or more of the diffusion tips may be aligned, such as the diffusion tips 308*b* and 308*c*.

The time delay associated with reflection generates a phase difference in the reflected pressure oscillations, which may interfere with the pressure oscillations 314*a* and 314*b* in the combustion chamber 104. Additionally, a first fuel concentration wave 316*a* and a second fuel concentration wave 316*b* may be generated in the premixers 302*a* and 302*b*, which may also interfere with the pressure oscillations 314*a* and 314*b* in the combustion chamber 104. Accordingly, an embodiment including both axially staggered vane packs and axially staggered diffusion tips, such as those illustrated by the premixers 302*a* and 302*b*, provides various choices for parameters $L_1$, $L_2$, $L_3$, $D_1$ and $D_2$ that may at least partially attenuate the combustion dynamics in the combustion chamber 104, with the mathematical analysis being similar to that as explained above. Increasing in the choice of available adjustable parameters, from three parameters ($L_1$, $D_1$, $D_2$), such as for an embodiment including axially staggered vane packs and axially aligned diffusion tips, to five parameters ($L_1$, $L_2$, $L_3$, $D_1$, $D_2$), such as in an embodiment including axially staggered vane packs and diffusion tips, increases the fuel flexibility of the engine while also providing improved engine emission performance.

It is appreciated that in other embodiments of the invention, various combinations of axially staggered components as described herein, may be employed to attenuate combustion dynamics of an engine. Furthermore, in other example embodiments diffusion tips may have one or more fuel orifices (not shown) for maintaining the flame during low operating load conditions, such as when the fuel-air mixture is very lean or when high hydrogen fuels like syn-gas are used. The optional inclusion of fuel orifices formed in the diffusion tip may further facilitate attenuating combustion dynamics of the combustion chamber.

FIG. 4 illustrates an example method by which an embodiment of the invention may operate. Provided is a flow chart 400, illustrating an example method for combusting fuel in a combustor, according to one embodiment of the invention.

The example method begins at block 402. At block 402 fuel and air may be mixed in a first premixer. The premixer includes at least one fuel nozzle, at least one air inlet duct, and at least one vane pack. The vane pack is positioned within the first premixer at a first axial position. Fuel may be pumped into the airflow through fuel orifices formed in one or more of the vane packs. The fuel may then be swirled by the first vane pack to facilitate uniform mixing between the fuel and the air.

Block 404 follows block 402, in which fuel and air may be mixed in a second premixer, in a manner substantially similar to that as described with reference to block 402. The second premixer also may include at least one fuel nozzle, at least one air inlet duct, and at least one vane pack. The vane pack is positioned at a second axial position, such that the first axial position of the vane pack within the first premixer and the second axial position of the vane pack in the second premixer are axially staggered with respect to each other.

Each vane pack in each of the premixers may include a plurality of vanes. Each of the vanes may be formed to have an exit location, or trailing edge. In example embodiments, the exit locations of each vane pack may be what are aligned at each axial position. In example embodiments, the fuel orifices in each vane pack may be axially aligned; though in other example embodiments, the fuel orifices in each vane pack may be axially staggered with respect to the others, as is more fully described with reference to FIGS. 2-3.

Each premixer may further include a diffusion tip. In example embodiments, the diffusion tips in each vane pack may be axially aligned with respect to the others; though in other example embodiments, the diffusion tips in each vane pack may be axially staggered with respect to the others, as is more fully described with reference to FIGS. 2-3.

Following block 404 is block 406, in which the fuel-air mixture may be discharged into the combustion chamber from both the first premixer and the second premixer for combustion.

Block 408 follows block 406, in which the fuel-air mixture in the combustion chamber is combusted. The axial staggering of the vane packs within at least the first and the second premixers attenuates combustion dynamics as described above with reference to FIGS. 2 and 3, for example. For example, during combustion, at least a portion of the mixed fuel and air causes a heat release oscillation that propagates upstream to the first premixer and the second premixer. A first fuel concentration wave in the first premixer and a second fuel concentration wave in the second premixer are then created, which travel downstream to the flame burning region. Because of the staggered vane packs, diffusion tips, fuel orifices, or any combination thereof, the second fuel concentration wave may be out of phase with the first fuel concentration wave, thus attenuating combustion dynamics.

In various combustion systems, combustion dynamics may occur as a result of lean fuel-air mixtures used to lower NOx emissions, for example. These instabilities may partly depend on the flame dynamics of the combustion flame, which in turn is governed by the nature of fuel used. Accordingly, methods and systems to reduce combustion dynamics may be configured to accommodate the use of different types of fuel, such as, syn-gas, natural gas, or the like. Axially staggering of vane packs, and optionally staggering diffusion tips, to reduce combustion dynamics may be adjusted to the nature of the fuel used. For example, different parameters, such as vane pack stagger, fuel orifice stagger, and/or diffusion tip stagger, as is described above with reference to FIG. 3, may be chosen to suppress combustion dynamics accordingly while also providing an increase in fuel flexibility of the engine and enhanced operability.

Many modifications and other embodiments of the example descriptions set forth herein to which these descriptions pertain will come to mind having the benefit of the teachings presented in the foregoing descriptions and the associated drawings. Thus, it will be appreciated the invention may be embodied in many forms and should not be limited to the example embodiments described above. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A combustion chamber for a gas turbine engine, comprising:

a first premixer and a second premixer oriented about an axis defined between an upstream end and a downstream end of a combustor, each premixer comprising at least one fuel injector, at least one air inlet duct, and at least one vane pack downstream of the at least one fuel injector for at least partially mixing air from the at least one air inlet duct and fuel from the at least one fuel injector;

wherein each of the vane packs comprises a plurality of fuel orifices through which at least a portion of the fuel and at least a portion of the air pass;

wherein the at least one vane pack of the first premixer is positioned at a first axial position relative to the axis and the at least one vane pack of the second premixer is positioned at a second axial position relative to the axis, wherein the second axial position is axially staggered with respect to the first axial position.

2. The combustion chamber of claim 1, wherein the at least one vane pack comprises a plurality of vanes, wherein each vane comprises an exit location, and wherein the exit location of the at least one vane pack of the first premixer is positioned at the first axial position and the exit location of the at least one vane pack of the second premixer is positioned at the second axial position.

3. The combustion chamber of claim 1, wherein the plurality of fuel orifices of the at least one vane pack of the first premixer are axially aligned with the plurality of fuel orifices of the at least one vane pack of the second premixer.

4. The combustion chamber of claim 1, wherein the plurality of fuel orifices of the at least one vane pack of the first premixer are axially staggered relative to the axis and with respect to the plurality of fuel orifices of the at least one vane pack of the second premixer.

5. The combustion chamber of claim 1 wherein the first premixer and the second premixer each further comprise a diffusion tip positioned downstream of the at least one vane pack, wherein the diffusion tip of the first premixer is axially aligned with the diffusion tip of the second premixer.

6. The combustion chamber of claim 1, wherein the first premixer and the second premixer each further comprise a diffusion tip positioned downstream of the at least one vane pack, wherein the diffusion tip of the first premixer is axially staggered with respect to the diffusion tip of the second premixer.

7. The combustion chamber of claim 1, wherein the relative spacing between the first axial position and the second axial position is selected to reduce combustion dynamics produced in the combustion chamber.

8. A method for combusting fuel in a combustion chamber, comprising:

mixing fuel and air in a first premixer oriented about an axis defined between an upstream end and a downstream end of a combustor, the first premixer comprising at least one fuel injector, at least one air inlet duct, and at least one vane pack downstream of the at least one fuel injector at a first axial position relative to the axis;

mixing fuel and air in a second premixer comprising at least one fuel injector, at least one air inlet duct, and at least one vane pack at downstream of the at least one fuel injector at a second axial position relative to the axis, wherein the second axial position is axially staggered with respect to the first axial position;

discharging the mixed fuel and air from the first premixer and the second premixer to a combustion chamber; and combusting at least a portion of the mixed fuel and air from the first premixer and the second premixer in the combustion chamber.

9. The method of claim 8, wherein the at least one vane pack comprises a plurality of vanes, each vane comprising an exit location, and wherein the exit location of the at least one vane pack of the first premixer is positioned at the first axial position and the exit location of the at least one vane pack of the second premixer is positioned at the second axial position.

10. The method of claim 8, wherein each of the plurality of vanes comprises a plurality of fuel orifices through which at least a portion of the fuel and at least a portion of the air pass, and wherein the plurality of fuel orifices of the at least one vane pack of the first premixer are axially aligned with the plurality of fuel orifices of the at least one vane pack of the second premixer.

11. The method of claim 8, wherein each of the plurality of vanes comprises a plurality of fuel orifices through which at least a portion of the fuel and at least a portion of the air pass, and wherein the plurality of fuel orifices of the at least one vane pack of the first premixer are axially staggered relative to the axis and with respect to the plurality of fuel orifices of the at least one vane pack of the second premixer.

12. The method of claim 8, wherein the first premixer and the second premixer each further comprise a diffusion tip positioned downstream of the at least one vane pack, and wherein the diffusion tip of the first premixer is axially aligned with the diffusion tip of the second premixer.

13. The method of claim 8, wherein the first premixer and the second premixer each further comprise a diffusion tip positioned at a location downstream of the at least one vane pack, and wherein the diffusion tip of the first premixer is axially staggered with respect to the diffusion tip of the second premixer.

14. The method of claim 8, wherein combusting at least a portion of the mixed fuel and air comprises facilitating a heat release oscillation that propagates upstream to the first premixer and the second premixer and produces first fuel concentration wave in the first premixer and a second fuel concentration wave in the second premixer which travel downstream to the flame burning region, the second fuel concentration wave out of phase with the first fuel concentration wave based at least in part on the relative separation of the first and second axial positions of the vane packs.

15. The method of claim 8, further comprising adjusting the axial location of at least one vane of the at least one vane pack of the first premixer or of at least one vane of the at least one vane pack of the second premixer when the type of fuel is changed from a first fuel to a second fuel.

16. A gas turbine engine, comprising:

a compressor;

a combustion chamber;

at least a first premixer and a second premixer associated with the combustion chamber and oriented about an axis defined between an upstream end proximate the compressor and a downstream end proximate the combustion chamber, each premixer comprising at least one fuel injector, at least one air inlet duct, and at least one vane pack downstream of the at least one fuel injector for at least partially mixing air from the at least one air inlet duct and fuel from the at least one fuel injector;

wherein each of the plurality of vanes comprises a plurality of fuel orifices through which at least a portion of the fuel and at least a portion of the air pass; and wherein the at least one vane pack of the first premixer is positioned within the first premixer at a first axial position relative to the axis and the at least one vane pack of the second premixer is positioned within the second premixer at a second axial position relative to the axis, wherein the second axial position is axially staggered with respect to the first axial position.

17. The gas turbine engine of claim 16, wherein the plurality of fuel orifices of the at least one vane pack of the first premixer are axially aligned with the plurality of fuel orifices of the at least one vane pack of the second premixer.

18. The gas turbine engine of claim 16, wherein the plurality of fuel orifices of the at least one vane pack of the first premixer are axially staggered relative to the axis and with respect to the plurality of fuel orifices of the at least one vane pack of the second premixer.

19. The gas turbine engine of claim 16, wherein the locations of the first axial position and the second axial position are selected to reduce combustion dynamics associated with the combustion chamber.

20. The gas turbine engine of claim 16, wherein the at least one vane pack comprises a first vane comprising a first plurality of fuel orifices and a second vane comprising a plurality of fuel orifices, and wherein the first plurality of fuel orifices are axially staggered relative to the axis and with respect to the second plurality of fuel orifices.

* * * * *